US010184644B2

(12) United States Patent
Stathes et al.

(10) Patent No.: US 10,184,644 B2
(45) Date of Patent: Jan. 22, 2019

(54) LIGHT FIXTURE BRACKET AND LIGHT FIXTURE ASSEMBLY

(71) Applicant: Hubbell Incorporated, Shelton, CT (US)

(72) Inventors: Nancy R. Stathes, Hillsdale, NJ (US); Federico Collado, Westwood, NJ (US); Ramesh Raghavan, Edison, NJ (US); Shailesh Naik, Dayton, NJ (US); Michael Swern, Boonton Township, NJ (US)

(73) Assignee: Hubbell Incorporated, Shelton, CT (US)

( * ) Notice: Subject to any disclaimer, the term of this patent is extended or adjusted under 35 U.S.C. 154(b) by 107 days.

(21) Appl. No.: 15/131,347

(22) Filed: Apr. 18, 2016

(65) Prior Publication Data

US 2016/0305635 A1 Oct. 20, 2016

Related U.S. Application Data

(60) Provisional application No. 62/148,842, filed on Apr. 17, 2015.

(51) Int. Cl.

| | |
|---|---|
| ***F21V 21/04*** | (2006.01) |
| ***F21S 8/02*** | (2006.01) |
| ***F21V 7/00*** | (2006.01) |
| ***F21V 17/10*** | (2006.01) |

(52) U.S. Cl.

CPC ..... *F21V 21/044* (2013.01); *F21V 7/00* (2013.01); *F21V 17/101* (2013.01); *F21V 21/041* (2013.01); *F21V 21/049* (2013.01); *F21S 8/026* (2013.01)

(58) Field of Classification Search

CPC ..... F21V 21/04–21/049; F21S 8/02–8/028

See application file for complete search history.

(56) References Cited

U.S. PATENT DOCUMENTS

| | | | | |
|---|---|---|---|---|
| 3,636,306 | A | 1/1972 | Bumpus | |
| 2,989,619 | A | 6/1981 | Springer | |
| 5,045,984 | A * | 9/1991 | Trowbridge | F21V 17/164 248/27.1 |
| 5,068,772 | A | 11/1991 | Shaprio et al. | |
| 5,908,263 | A * | 6/1999 | Conners | E01C 17/00 362/153 |
| 5,931,432 | A | 8/1999 | Herold et al. | |
| 8,628,224 | B1 * | 1/2014 | Speidel | F21V 17/002 362/277 |
| 8,979,329 | B1 * | 3/2015 | Moore | F21V 7/10 29/428 |
| 9,052,101 | B1 * | 6/2015 | Kathawate | F21V 21/046 |
| 2005/0231954 | A1 | 10/2005 | Czech | |

(Continued)

OTHER PUBLICATIONS

PCT/US2016/028057 International Search Report and Written Opinion dated Jul. 8, 2016.

*Primary Examiner* — Mariceli Santiago

(74) *Attorney, Agent, or Firm* — Michael Best & Friedrich, LLP

(57) ABSTRACT

A bracket for use with a recessed light fixture includes a side wall. A first bendable tab is positioned in the side wall. A second bendable tab is positioned in the side wall, the second tab being offset from the first tab. A retainer extends from the side wall.

21 Claims, 8 Drawing Sheets

(56) References Cited

U.S. PATENT DOCUMENTS

| | | | | |
|---|---|---|---|---|
| 2006/0034069 | A1* | 2/2006 | Seo | F21V 21/04 362/147 |
| 2009/0010007 | A1* | 1/2009 | Caluori | F21V 21/04 362/366 |
| 2010/0165607 | A1 | 7/2010 | Russo et al. | |
| 2014/0140075 | A1* | 5/2014 | Schmitt | F21V 21/045 362/382 |
| 2016/0230947 | A1* | 8/2016 | Bilodeau | F21S 8/026 |

* cited by examiner

LIGHT FIXTURE BRACKET AND LIGHT FIXTURE ASSEMBLY

RELATED APPLICATION

This application is based on U.S. Provisional Application Ser. No. 62/148,842, filed Apr. 17, 2015, the disclosure of which is incorporated herein by reference in its entirety and to which priority is claimed.

FIELD

Various exemplary embodiments relate to recessed lighting assemblies.

BACKGROUND

Light fixtures, or luminaires, are used with electric light sources to provide aesthetic and functional housing in both interior and exterior applications. One type of light fixture is a recessed lighting. Recessed lighting fixtures or downlights provide lighting for a space, such as a building or room, and are aesthetically pleasing since the fixtures are advantageously recessed in a support such as a ceiling. Being installed behind a frame or above a ceiling, however, limits accessibility, making it costly and time consuming to repair or replace components in the recessed light fixture. Typically, modifications to an installed lighting assembly require removal of the assembly or various components from the ceiling.

SUMMARY

According to an exemplary embodiment, a bracket for use with a recessed light fixture includes a side wall. A first bendable tab is positioned in the side wall. A second bendable tab is positioned in the side wall, the second tab being offset from the first tab. A retainer extends from the side wall.

According to another exemplary embodiment, a lighting assembly includes a bracket having a side wall. A first bendable tab is positioned in the side wall. A second bendable tab is positioned in the side wall with the second tab being offset from the first tab. A retainer extends from the side wall. A light fixture is connected to the bracket.

Another exemplary embodiment includes a method of installing a light fixture. The method includes making an opening in a support. A bracket is positioned in the opening. The bracket has a side wall, a first bendable tab positioned in the side wall, and a second bendable tab positioned in the side wall. The second tab is offset from the first tab. One of the first or second tabs is bent to engage a surface of the support. A light fixture is connected to the bracket.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

The various exemplary embodiments described herein are directed to lighting assemblies for new and retrofit applications. The exemplary embodiments describe lighting assemblies that are mounted in a wall or ceiling, although they can also be used with other types of lighting assemblies. In certain embodiments, the lighting assembly can be installed entirely from below a ceiling panel or similar support structure.

Figure 1:
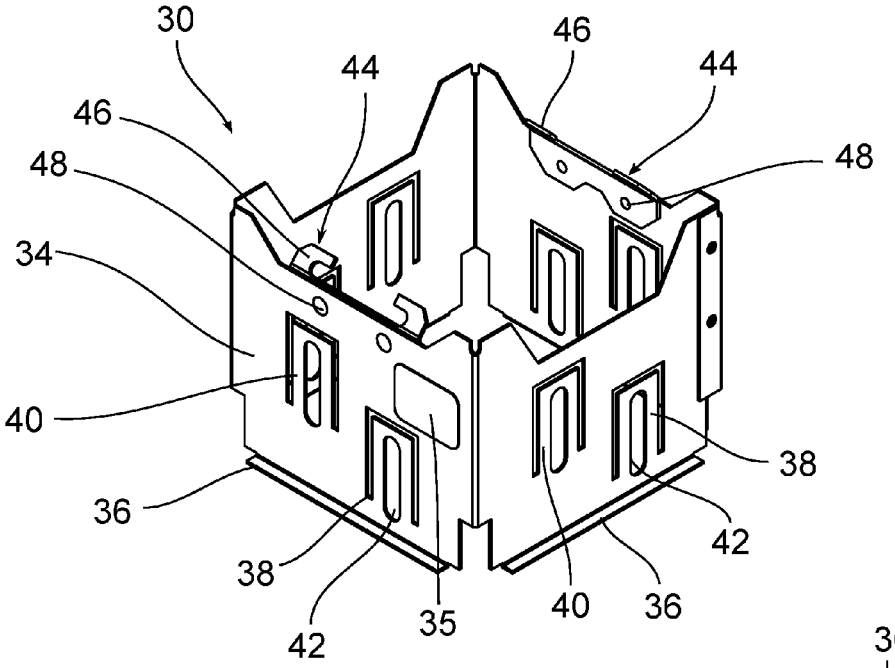
FIG. 1 is a perspective view of an exemplary bracket.
Figure 2:
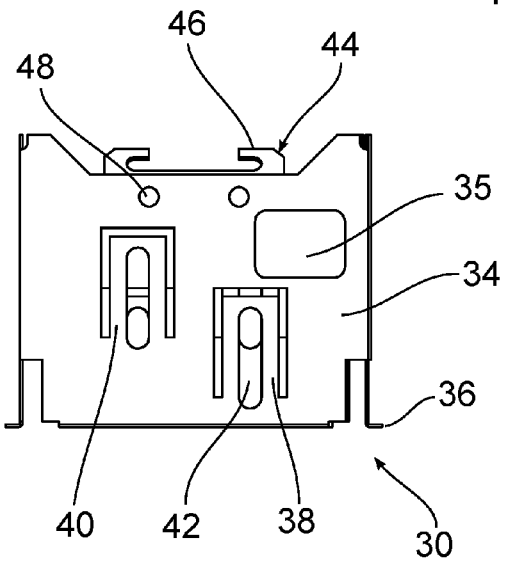
FIG. 2 is a side view of FIG. 1.
Figure 3:
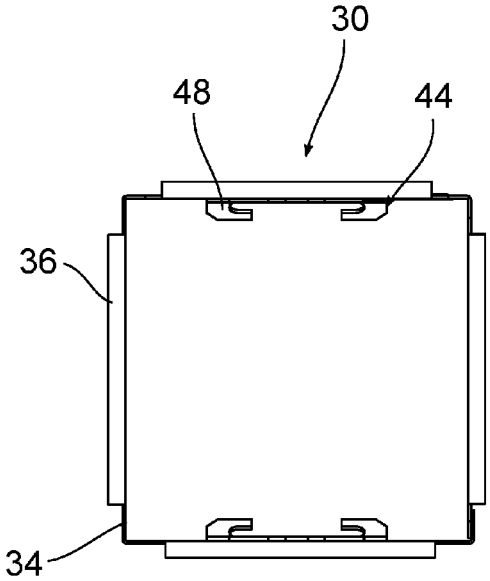
FIG. 3 is a top view of FIG. 1.

FIGS. 1-3 show an exemplary embodiment of a bracket 30 that can assist the mounting of a light fixture in a support 32. The bracket 30 includes a plurality of side walls 34. Four side walls 34 are shown with the bracket 30 having a substantially square configuration. Other alternative embodiments can utilize more or fewer side walls 34, including a single curvilinear side wall 34, or any combination of rectilinear or curvilinear side walls 34 having a variety of lengths to create different configurations suitable to a desired application. The side walls 34 can be integrally formed, for example in a single sheet and bent to form the desired configuration. The side walls 34 may also be formed individually. A label 35 can be connected to one or more of the side walls 34 to provide information about the light assembly.

In the illustrated exemplary embodiment, each side wall 34 includes a bottom flange 36, a first tab 38, and a second tab 40. The bottom flange can engage or be positioned proximate the bottom surface of a support 32. The tabs 38 can be bent so that they extend outwardly from the side wall 34 to engage the top surface of a support 32. The second tab 40 is offset from the first tab 38 to accommodate different support 32 thicknesses with the same bracket 30. In an exemplary embodiment the first and second tabs 38, 40 can be bent by hand without use of a tool. The first and second tabs 38, 40 can include a slot or opening 42 to increase flexibility. Although first and second tabs 38, 40 are shown on each side wall 34, various alternative embodiments can utilize more or fewer tabs on each side wall 34 and tabs may be completely omitted from one or more side walls 34. One or more side walls 34 can also include alternative mounting features as would be understood by one or ordinary skill in the art.

Figure 8:
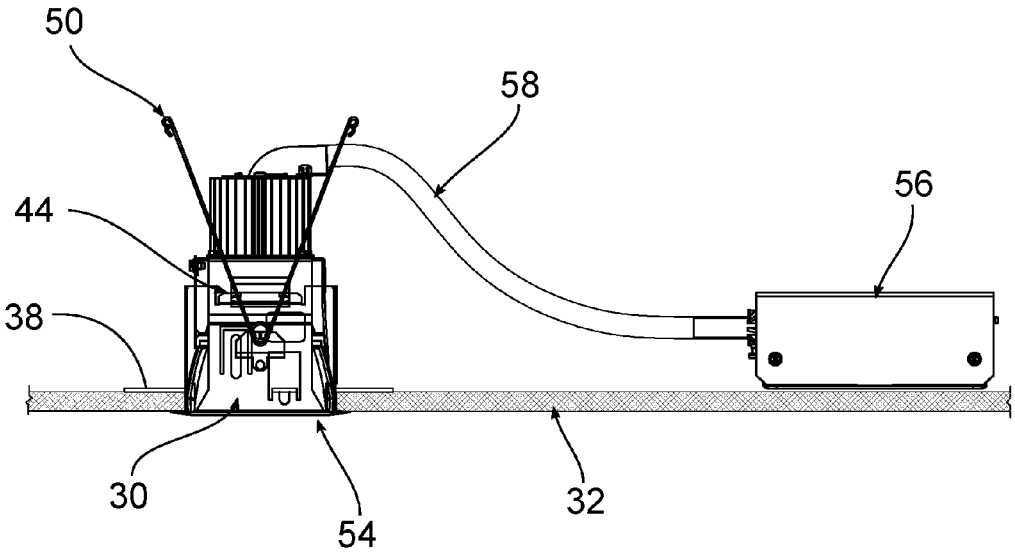
FIG. 8 is a side view of the light fixture placed in the bracket.

One or more of the side walls 34 can also include one or more retainers 44. In an exemplary embodiment, the retainers include first and second prongs 46 that extend from the top of the side wall 34 at an angle into a central region of the bracket 30. The retainers 44 are shown on two of the side walls 34, although fewer or more retainers 44 can be used. The retainers 44 can be formed integrally with the bracket 30 or connected through welding or fasteners, for example rivets 48 as best shown in FIGS. 1 and 2. The retainer 44 connects to or receives a portion of the light assembly, for example a torsion spring 50, as shown in FIG. 8.

Figure 4:
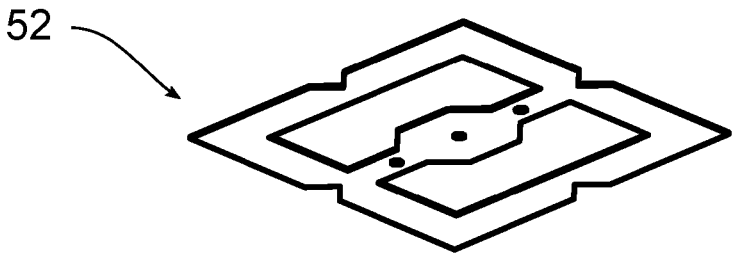
FIG. 4 is a perspective view of an exemplary template.
Figure 5:
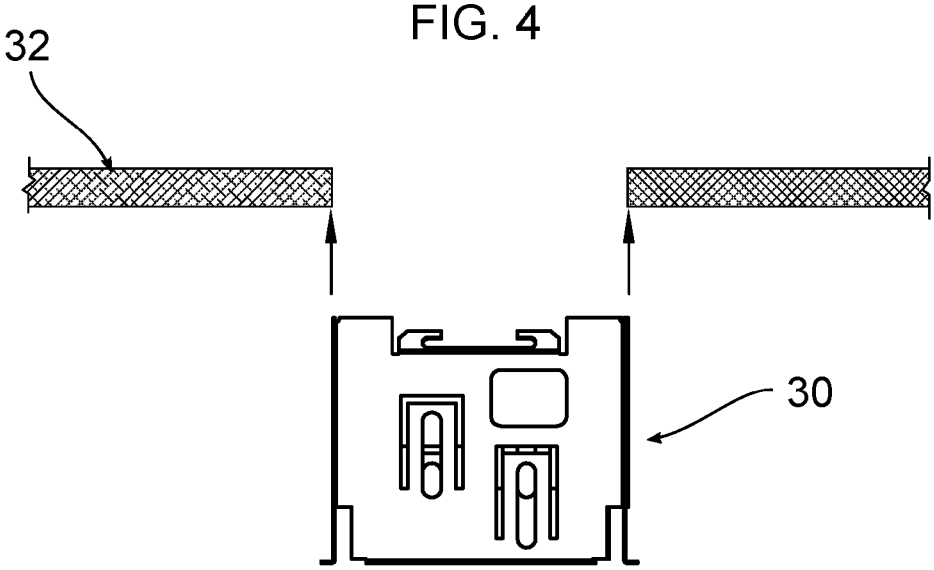
FIG. 5 is a side view of the bracket being placed in an opening of a support.
Figure 6:
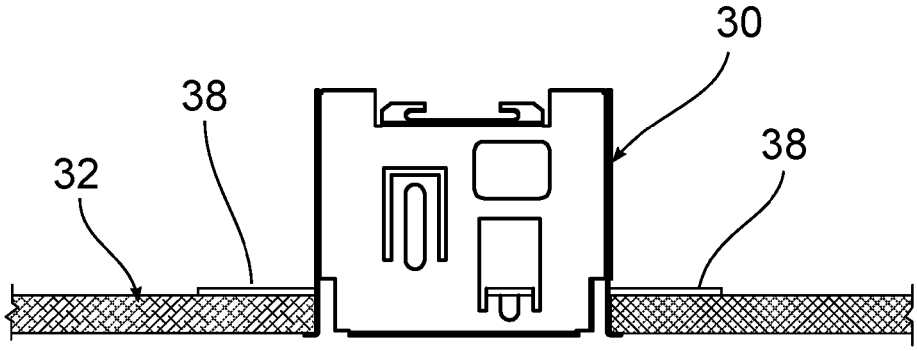
FIG. 6 is a side view of the bracket placed in the support.
Figure 7:
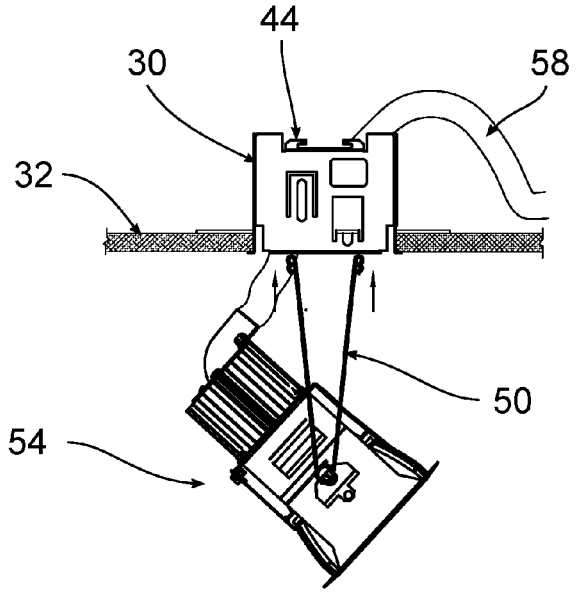
FIG. 7 is a side view of a light fixture being placed in the bracket.

FIGS. 4-8 show an exemplary installation of a light assembly using the bracket 30. FIG. 4 shows an exemplary template 52 that is used to cut an opening in a support 32 to receive the bracket 30. The size, shape, and configuration of the template 52 can vary depending on the bracket 30. After the opening has been cut, the bracket 30 is placed into the opening and the first or second tab 38, 40 is bent to engage the top of the support 32. A light fixture 54 is then positioned in the bracket 30. The light fixture 54 can be connected to a power supply, for example a driver 56. The driver 56 can be positioned on the support 32 prior to installation or after the opening is formed in the support 32. A conduit 58 connects one or more conductors to the light fixture 54. One or more torsion springs 50 are connected to the light fixture 54 and are squeezed together to be passed through the bracket 30. After being inserted into the bracket 30, the torsion springs 50 can expand into the retainers 44 and be held by the prongs 46. In an exemplary embodiment, the ends of the torsion springs 50 include hooks that will engage the top edge of the side walls 34 to prevent the light fixture 54 from completely falling out if it is dropped down for service or replacement. To remove the light fixture 54 a user can pull the light fixture 54, depress the torsion springs 50, and disengage the torsion springs 50 from the retainers 44.

Figure 9:
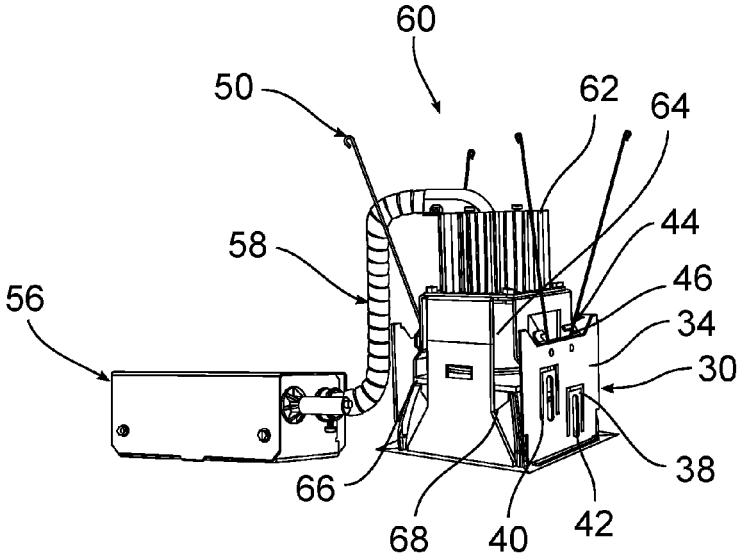
FIG. 9 is a perspective view of a square-aperture, downlight fixture connected to the bracket with a side wall of the bracket removed.
Figure 10:
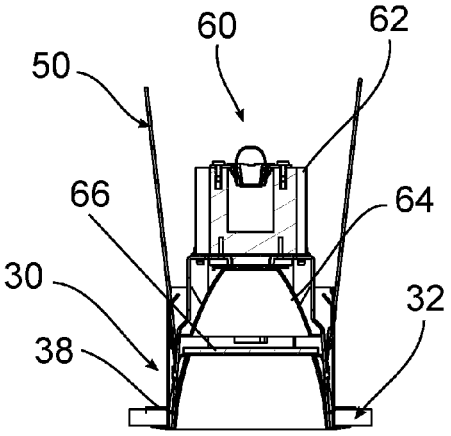
FIG. 10 is a front, sectional view of a square-aperture, narrow beam downlight fixture connected to the bracket.
Figure 11:
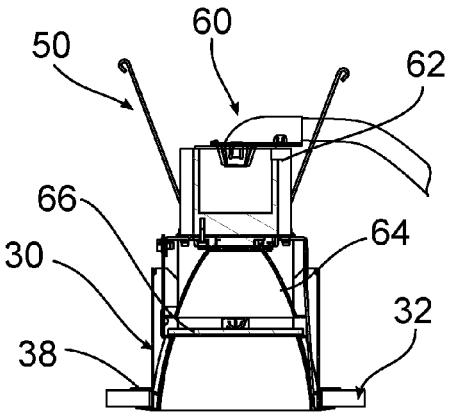
FIG. 11 is a side, sectional view of FIG. 10.

FIGS. 9-11 show an exemplary downlight fixture 60 connected to the bracket 30. The downlight fixture 60 includes a heat sink 62, a primary reflector 64, an optic 66, for example a prismatic diffuser, and a trim member 68. The primary reflector 64 is a narrow beam reflector, although other types of reflectors can be used, including medium and wide beam reflectors.

Figure 12:
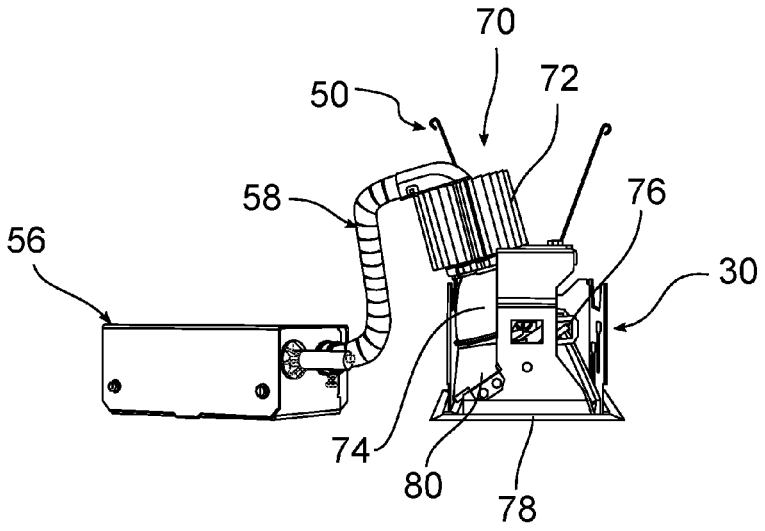
FIG. 12 is a perspective view of a square-aperture, wall wash fixture connected to the bracket with a side wall of the bracket removed.
Figure 13:
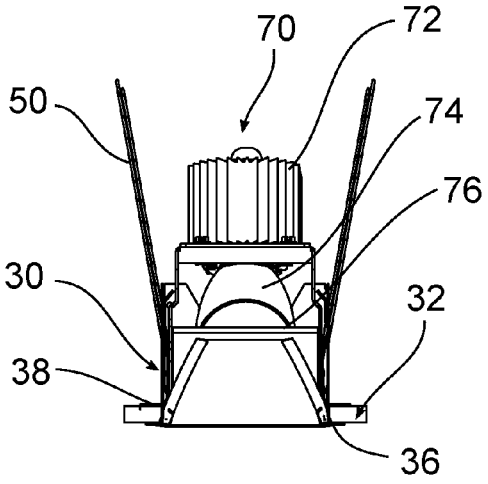
FIG. 13 is a front, sectional view of a square-aperture, narrow beam wall wash fixture connected to the bracket.
Figure 14:
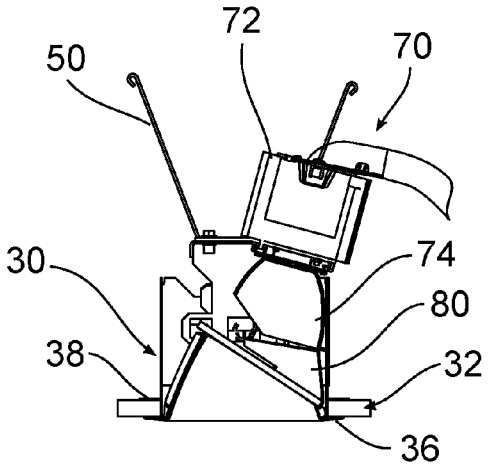
FIG. 14 is a side, sectional view of FIG. 13.

FIGS. 12-14 show an exemplary wall wash fixture 70. The wall wash fixture 70 includes a heat sink 72, a primary reflector 74, an optic 76, for example a lens, a trim member 78 and a kick reflector 80. One or more brackets and/or fasteners connect the various components in both of the light fixtures 60, 70. The primary reflector 74 is a wide beam reflector, although other types of reflectors can be used, including medium and narrow beam reflectors.

Figure 15:
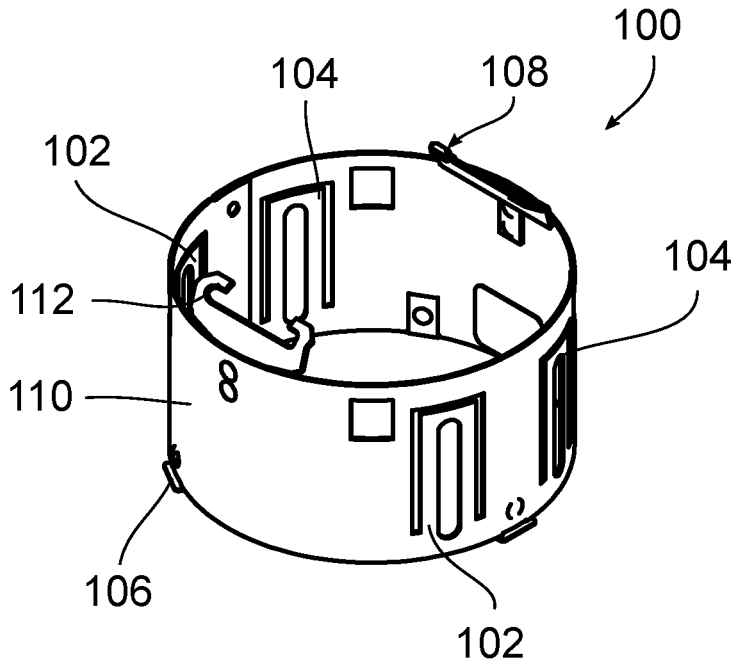
FIG. 15 is a top perspective view of an exemplary cylindrical bracket.
Figure 16:
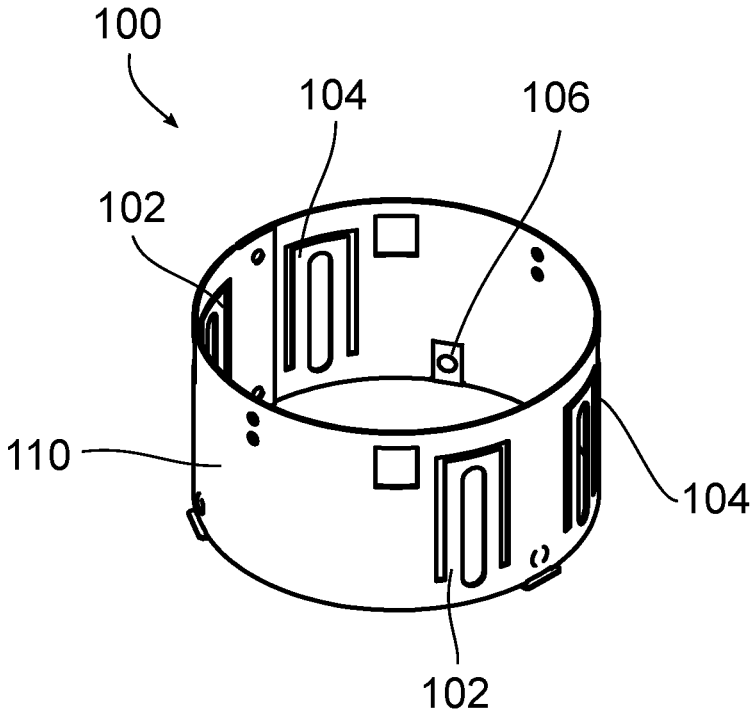
FIG. 16 is a top perspective view of the bracket of FIG. 15 with the retainers removed.

FIGS. 15 and 16 show an exemplary cylindrical bracket 100 for use with round-aperture light fixtures. The cylindrical bracket 100 can have one or more side walls no arranged in a substantially cylindrical shape. For example a single side wall no can be shaped into a cylinder and riveted to itself or multiple side walls no can be connected together to form a cylinder. In the illustrated exemplary embodiment, the bracket 100 includes one or more bendable tabs, for example sets of opposing first tabs 102 and second tabs 104. One or more bottom flanges 106 extend from the side wall no and can engage or be positioned proximate the bottom surface of a support 32. The flanges 106 can be integrally formed with the side wall no or connected thereto, for example with a fastener such as a rivet.

The tabs 102, 104 can be bent so that they extend outwardly from the side wall no to engage the top surface of a support 32. In an exemplary embodiment the first and second tabs 102, 104 can be bent by hand without use of a tool. A slot is formed in the first and second tabs 102, 104 to increase flexibility. Although two sets of first and second tabs 102, 104 are shown, various alternative embodiments can utilize more or fewer tabs. The cylindrical bracket 100 can also include alternative mounting features as would be understood by one or ordinary skill in the art.

The cylindrical bracket 100 can also include one or more retainers 108. In an exemplary embodiment, the retainers 108 include first and second prongs 112 that extend from the top of the bracket 100 at angle extending into a central region of the bracket 100. Two retainers 108 are shown in FIG. 15, although fewer or more retainers 108 can be used. The retainers 108 can be formed integrally with the bracket 108 or connected through welding or fasteners, for example rivets. The retainer 108 connects to or receives a portion of the light assembly, for example a torsion spring 50. In an exemplary embodiment, the retainers 108 can be bent after installation. FIG. 16 shows a cylindrical bracket 100 where the retainers 108 have been removed for use with light fixtures that do not include a torsion spring, for example the adjustable light fixtures shown in FIGS. 19-20.

Figure 17:
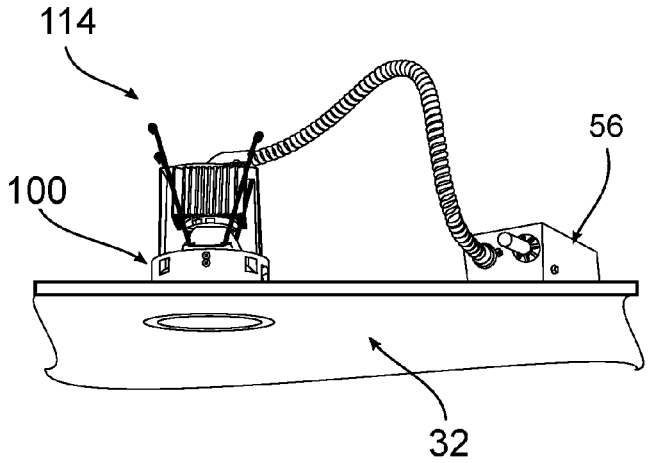
FIG. 17 is a perspective view of a round-aperture, downlight fixture and the exemplary cylindrical bracket.
Figure 18:
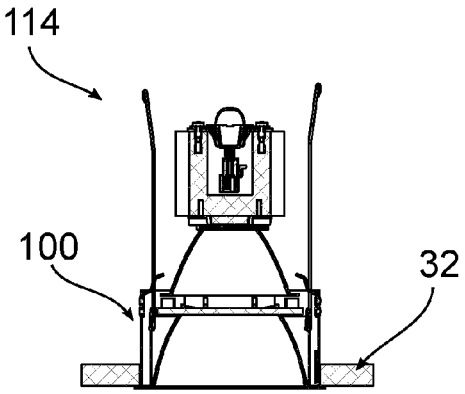
FIG. 18 is a front, sectional view of a round-aperture, narrow beam downlight fixture connected to the cylindrical bracket.
Figure 19:
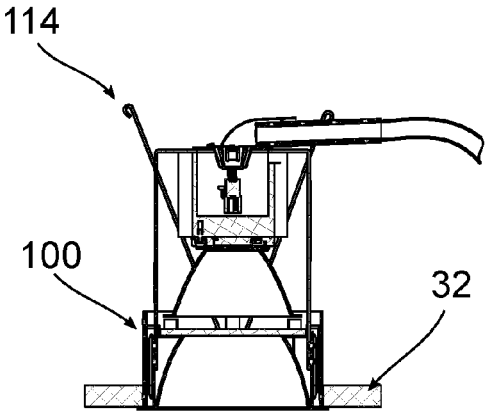
FIG. 19 is a side, sectional view of FIG. 18.
Figure 20:
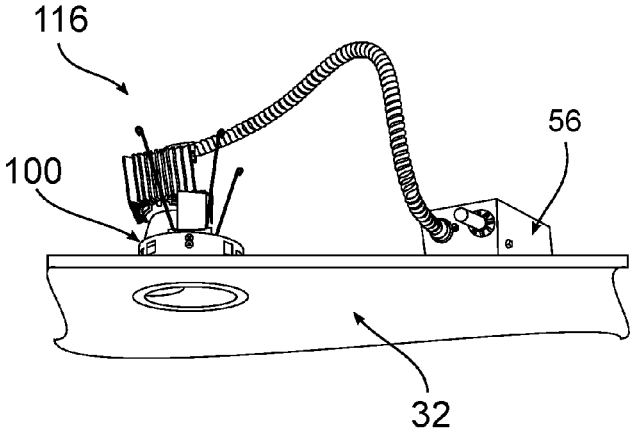
FIG. 20 is a perspective view of a round-aperture, wall wash fixture and the cylindrical bracket.
Figure 21:
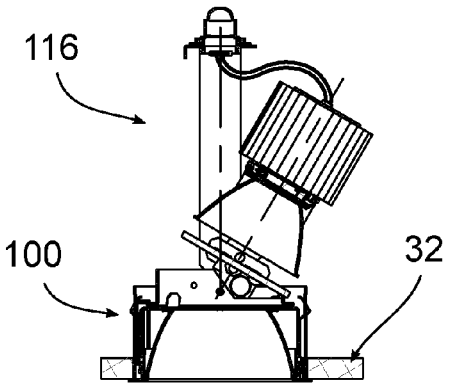
FIG. 21 is a front, sectional view of a round-aperture, narrow beam adjustable fixture connected to the cylindrical bracket.
Figure 22:
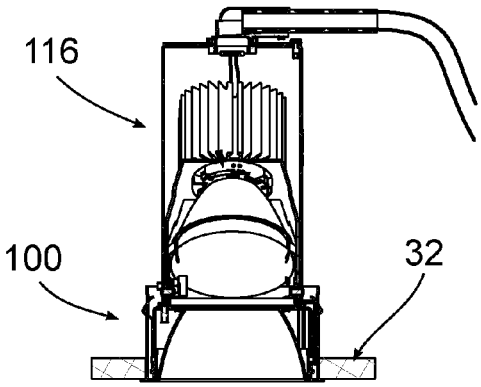
FIG. 22 is a front, sectional view of FIG. 21.

FIGS. 17-20 show exemplary light fixtures connected to the cylindrical bracket 100 and a support 32. FIGS. 17-19 show a round-aperture, narrow beam downlight fixture 114. FIGS. 20-22 show a round-aperture, narrow beam adjustable fixture 116. Other types of reflectors can be used for both downlight and adjustable applications, including medium and wide beam reflectors.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A bracket for use with a recessed light fixture comprising:

a side wall bounding an interior portion;

a first bendable tab positioned in the side wall;

a second bendable tab positioned in the side wall, the second tab being offset from the first tab and positioned above the first bendable tab; and a retainer extending from the side wall, wherein the first bendable tab and the second bendable tab are bendable outwardly from the side wall away from the interior portion to a position configured to engage the top surface of a support extending perpendicular to the side wall.

2. The bracket of claim 1, wherein a slot extends through the first bendable tab.

3. The bracket of claim 1, wherein the side wall has a cylindrical configuration.

4. The bracket of claim 1, the side wall is one of a plurality of side walls arranged in a rectilinear configuration.

5. The bracket of claim 1, wherein a bottom flange extends from the side wall.

6. The bracket of claim 1, wherein the first and second tabs are bendable by hand.

7. The bracket of claim 1, wherein the retainer include a first prong and a second prong.

8. The bracket of claim 1, wherein the retainer is formed integrally with the bracket.

9. The bracket of claim 1, wherein the retainer is connected to the bracket by a fastener.

10. The bracket of claim 1, wherein the retainer extends at an angle towards a central region of the bracket.

11. The bracket of claim 1, wherein the first and second tabs are bendable to be perpendicular to the side wall.

12. A lighting assembly comprising:

a bracket having a side wall bounding an interior portion, a first bendable tab positioned in the side wall, a second bendable tab positioned in the side wall, the second tab being offset from the first tab and positioned above the first tab, and a retainer extending from the side wall; and a light fixture connected to the bracket, wherein the first bendable tab and the second bendable tab are bendable outwardly from the side wall away from the interior portion to a position configured to engage the top surface of a support extending perpendicular to the side wall.

13. The lighting assembly of claim 12, wherein one of the first tab or the second tab contacts an upper surface of the support.

14. The lighting assembly of claim 12, wherein the light fixture is a downlight fixture.

15. The lighting assembly of claim 12, wherein the light fixture is a wall wash fixture.

16. The lighting assembly of claim 12, wherein the light fixture is an adjustable fixture.

17. The lighting assembly of claim 12, wherein the light fixture is one of a narrow beam, medium beam, or a wide beam fixture.

18. The lighting assembly of claim 12, wherein the light fixture includes a torsion spring and the torsion spring is connected to the retainer.

19. A method of installing a light fixture comprising:

making an opening in a ceiling having a top surface and a bottom surface;

positioning a bracket in the opening, the bracket having a side wall, a first bendable tab positioned in the side wall, a second bendable tab positioned in the side wall, the second tab being offset from the first tab and positioned above the first tab;

bending one of the first or second tabs to engage the top surface; and connecting a light fixture to the bracket.

20. The method of claim 19, wherein the first or second tab is selected to correspond to the thickness of the ceiling.

21. The method of claim 19, wherein the bracket includes a retainer extending from the side wall and connecting the light fixture includes compressing a torsion spring and inserting the torsion spring into the retainer.

* * * * *